US008267504B2

(12) United States Patent
Baumer et al.

(10) Patent No.: US 8,267,504 B2
(45) Date of Patent: Sep. 18, 2012

(54) PRINTHEAD INCLUDING INTEGRATED STIMULATOR/FILTER DEVICE

(75) Inventors: Michael F. Baumer, Dayton, OH (US); Ali G. Lopez, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 224 days.

(21) Appl. No.: 12/767,846

(22) Filed: Apr. 27, 2010

(65) Prior Publication Data

US 2011/0261118 A1 Oct. 27, 2011

(51) Int. Cl.
*B41J 2/05* (2006.01)

(52) U.S. Cl. ..... 347/63; 347/56; 347/93

(58) Field of Classification Search ..... 347/20, 347/56, 61–65, 67, 92–94, 73–83
See application file for complete search history.

(56) References Cited

U.S. PATENT DOCUMENTS

| | | | | |
|---|---|---|---|---|
| 4,068,241 | A | 1/1978 | Yamada | |
| 4,636,808 | A | 1/1987 | Herron | |
| 4,638,327 | A | 1/1987 | Sutera et al. | |
| 4,639,748 | A | 1/1987 | Drake et al. | |
| 4,894,664 | A * | 1/1990 | Tsung Pan | 347/63 |
| 5,124,717 | A | 6/1992 | Campanelli et al. | |
| 5,141,596 | A | 8/1992 | Hawkins et al. | |
| 5,204,690 | A | 4/1993 | Lorenze, Jr. et al. | |
| 5,489,930 | A | 2/1996 | Anderson | |
| 5,691,753 | A | 11/1997 | Hilton | |
| 6,079,821 | A | 6/2000 | Chwalek et al. | |
| 6,234,623 | B1 | 5/2001 | Drake | |
| 6,264,309 | B1 | 7/2001 | Sullivan | |
| 6,267,251 | B1 | 7/2001 | Sullivan | |
| 6,280,643 | B1 | 8/2001 | Silverbrook | |
| 6,365,058 | B1 * | 4/2002 | Beatty et al. | 347/63 |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,582,064 | B2 | 6/2003 | Cruz-Uribe et al. | |
| 6,583,350 | B1 | 6/2003 | Gee et al. | |
| 6,588,888 | B2 | 7/2003 | Jeanmaire et al. | |
| 6,626,522 | B2 | 9/2003 | Rapp et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 6,905,619 | B2 | 6/2005 | Kawamura et al. | |
| 6,916,090 | B2 | 7/2005 | Valley et al. | |
| 6,923,530 | B2 | 8/2005 | Anderson et al. | |

(Continued)

FOREIGN PATENT DOCUMENTS

| | | |
|---|---|---|
| EP | 901 906 | 3/1999 |

(Continued)

*Primary Examiner* — Juanita D Jackson
(74) *Attorney, Agent, or Firm* — William R. Zimmerli

(57) ABSTRACT

A jetting module includes a nozzle plate, a thermal stimulation membrane, and an enclosure. Portions of the nozzle plate define a nozzle. The thermal stimulation membrane includes a plurality of pores. At least one of the plurality of pores overlaps the nozzle when viewed from a direction through the nozzle. The enclosure includes a wall that extends from the nozzle plate to the thermal stimulation membrane to define a liquid chamber positioned between the nozzle plate and the thermal stimulation membrane. The liquid chamber is in fluid communication with the nozzle. The liquid chamber is in fluid communication with the plurality of pores of the thermal stimulation membrane.

11 Claims, 10 Drawing Sheets

U.S. PATENT DOCUMENTS

| | | | |
|---|---|---|---|
| 6,943,037 | B2 | 9/2005 | Anagnostopoulos et al. |
| 7,101,030 | B2 | 9/2006 | Clark et al. |
| 7,607,766 | B2 | 10/2009 | Steiner |
| 2004/0012662 | A1 | 1/2004 | Kneezel et al. |
| 2004/0179073 | A1 | 9/2004 | Valley et al. |
| 2005/0018022 | A1 | 1/2005 | Studer et al. |
| 2005/0151798 | A1 | 7/2005 | Merz et al. |

FOREIGN PATENT DOCUMENTS

| | | |
|---|---|---|
| EP | 1 095 776 | 10/2006 |

* cited by examiner

PRINTHEAD INCLUDING INTEGRATED STIMULATOR/FILTER DEVICE

CROSS REFERENCE TO RELATED APPLICATIONS

Reference is made to commonly-assigned, U.S. patent applications Ser. No. 12/767,833, entitled "PRINTHEAD INCLUDING SECTIONED STIMULATOR/FILTER DEVICE", Ser. No. 12/767,840, entitled "PRINTHEAD STIMULATOR/FILTER DEVICE PRINTING METHOD", Ser. No. 12/767,836, entitled "STIMULATOR/FILTER DEVICE THAT SPANS PRINTHEAD LIQUID CHAMBER", all filed concurrently herewith.

FIELD OF THE INVENTION

This invention relates generally to the field of digitally controlled printer systems and in particular, to the stimulation and filtering of liquids that are subsequently emitted through a nozzle of a printhead of the system.

BACKGROUND OF THE INVENTION

Traditionally, digitally controlled color printing capability is accomplished by one of two technologies Ink is fed through channels formed in the printhead. Each channel includes a nozzle from which droplets of ink are selectively extruded and deposited upon a medium. Typically, each technology requires separate ink delivery systems for each ink color used in printing. Ordinarily, the three primary subtractive colors, i.e. cyan, yellow and magenta, are used because these colors can produce, in general, up to several million shades or color combinations.

The first technology, commonly referred to as "droplet on demand" ink jet printing, selectively provides ink droplets for impact upon a recording surface using a pressurization actuator (thermal, piezoelectric, etc.). Selective activation of the actuator causes the formation and ejection of an ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle helping to keep the nozzle clean.

Conventional droplet on demand ink jet printers utilize a heat actuator or a piezoelectric actuator to produce the ink jet droplet at orifices of a print head. With heat actuators, a heater, placed at a convenient location, heats the ink to cause a localized quantity of ink to phase change into a gaseous steam bubble that raises the internal ink pressure sufficiently for an ink droplet to be expelled. With piezoelectric actuators, a mechanical force causes an ink droplet to be expelled.

The second technology, commonly referred to as "continuous stream" or simply "continuous" ink jet printing, uses a pressurized ink source that produces a continuous stream of ink droplets. Traditionally, the ink droplets are selectively electrically charged. Deflection electrodes direct those droplets that have been charged along a flight path different from the flight path of the droplets that have not been charged. Either the deflected or the non-deflected droplets can be used to print on receiver media while the other droplets go to an ink capturing mechanism (catcher, interceptor, gutter, etc.) to be recycled or disposed. U.S. Pat. No. 1,941,001, issued to Hansell, on Dec. 26, 1933, and U.S. Pat. No. 3,373,437 issued to Sweet et al., on Mar. 12, 1968, each disclose an array of continuous ink jet nozzles wherein ink droplets to be printed are selectively charged and deflected towards the recording medium.

In another form of continuous ink jet printing, for example, as described in U.S. Pat. No. 6,491,362 B1, issued to Jeanmaire, on Dec. 10, 2002, commonly assigned, included herein by reference, stimulation devices are associated with various nozzles of the printhead. These stimulation devices perturb the liquid streams emanating from the associated nozzle or nozzles in response to drop formation waveforms supplied to the stimulation devices by control means. The perturbations initiate the separation of a drop from the liquid stream. Different waveforms can be employed to create drops of a plurality of drop volumes. A controlled sequence of waveforms supplied to the stimulation device yields a sequence of drops, whose drop volumes are controlled by the waveforms used. A drop deflection device applies a force to the drops to cause the drop trajectories to separate based on the size of the drops. Some of the drop trajectories are allowed to strike the print media while others are intercepted by a catcher or gutter.

While conventional thermal stimulation devices are effective in initiating the break off of drops from the liquid streams, the stimulation amplitudes can be relatively low. Under certain conditions it is desirable to employ higher stimulation amplitudes. As such, there is an ongoing need for a thermal stimulation actuator capable of providing higher stimulation amplitudes that is suitable for use in a continuous printer system.

SUMMARY OF THE INVENTION

According to an aspect of the present invention, a jetting module includes a nozzle plate, a thermal stimulation membrane, and an enclosure. Portions of the nozzle plate define a nozzle. The thermal stimulation membrane includes a plurality of pores. At least one of the plurality of pores overlaps the nozzle when viewed from a direction through the nozzle. The enclosure includes a wall that extends from the nozzle plate to the thermal stimulation membrane to define a liquid chamber positioned between the nozzle plate and the thermal stimulation membrane. The liquid chamber is in fluid communication with the nozzle. The liquid chamber is in fluid communication with the plurality of pores of the thermal stimulation membrane.

According to another aspect of the present invention, a printhead includes a jetting module and a liquid source. The jetting module includes a nozzle plate, a thermal stimulation membrane, and an enclosure. Portions of the nozzle plate define a nozzle. The thermal stimulation membrane includes a plurality of pores. At least one of the plurality of pores overlaps the nozzle when viewed from a direction through the nozzle. The enclosure includes a wall that extends from the nozzle plate to the thermal stimulation membrane to define a liquid chamber positioned between the nozzle plate and the thermal stimulation membrane. The liquid chamber is in fluid communication with the nozzle. The liquid chamber is in fluid communication with the plurality of pores of the thermal stimulation membrane. The liquid source provides a liquid under pressure sufficient to jet an individual stream of the liquid from the nozzle of the jetting module.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
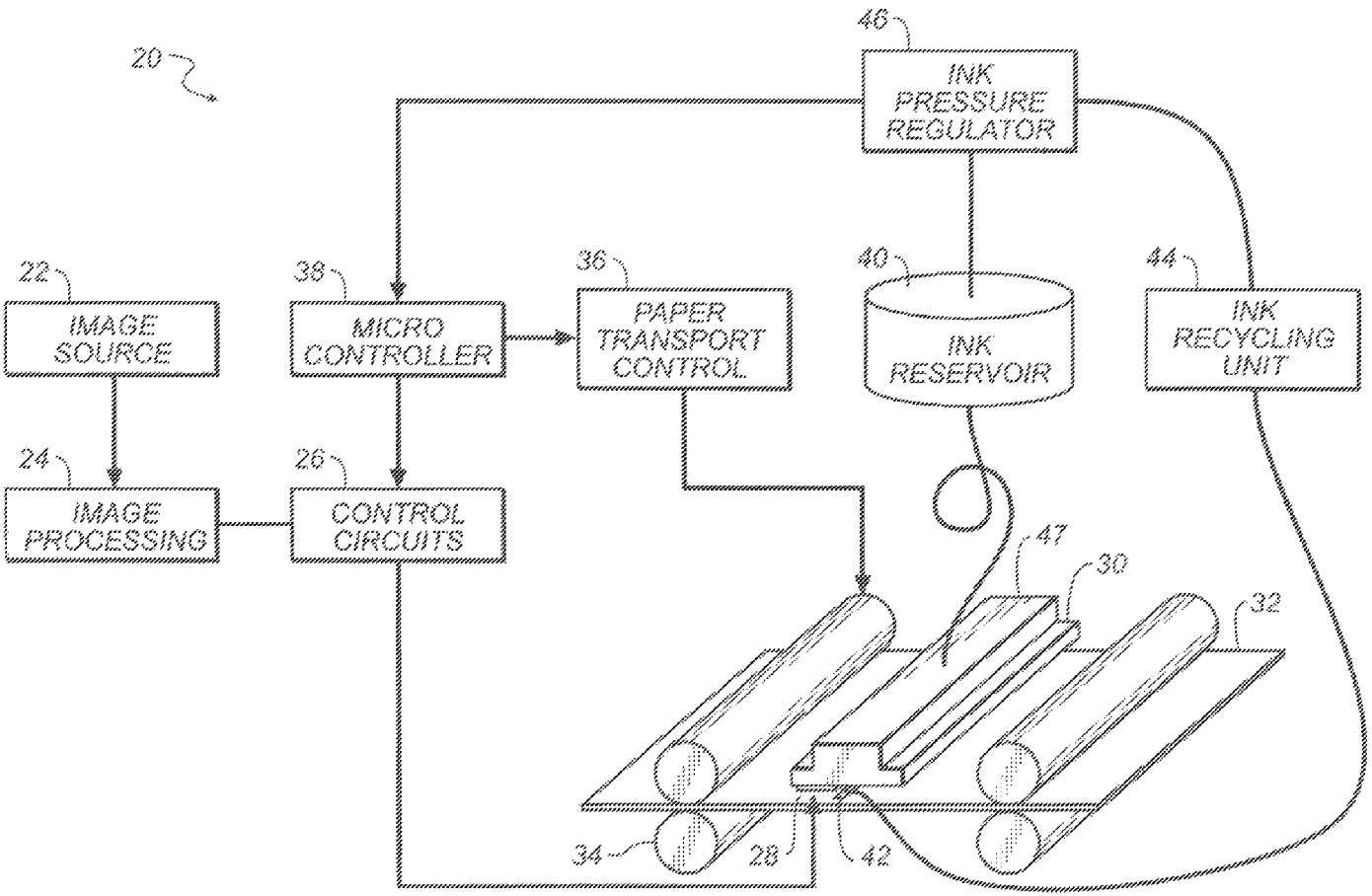
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming device control circuits 26 reads data from the image memory and apply time-varying electrical pulses to a drop forming device(s) 28 that are associated with one or more nozzles of a printhead 30. These electrical pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles is situated. When printhead 30 is fabricated from silicon, drop forming mechanism control circuits 26 can be integrated with the printhead. Printhead 30 also includes a deflection mechanism which is described in more detail below with reference to FIGS. 2 and 3.

Figure 2:
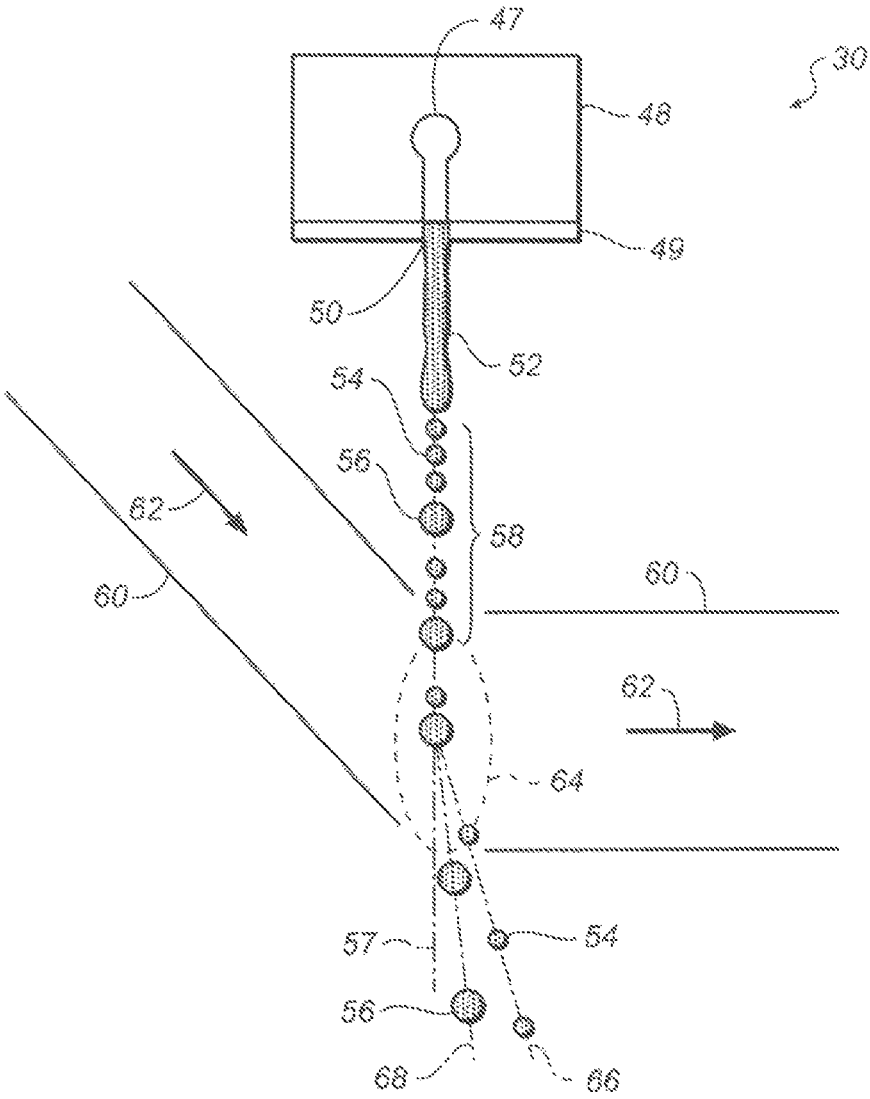
FIG. 2 is a schematic view of an example embodiment of a continuous printhead made in accordance with the present invention.
Figure 3:
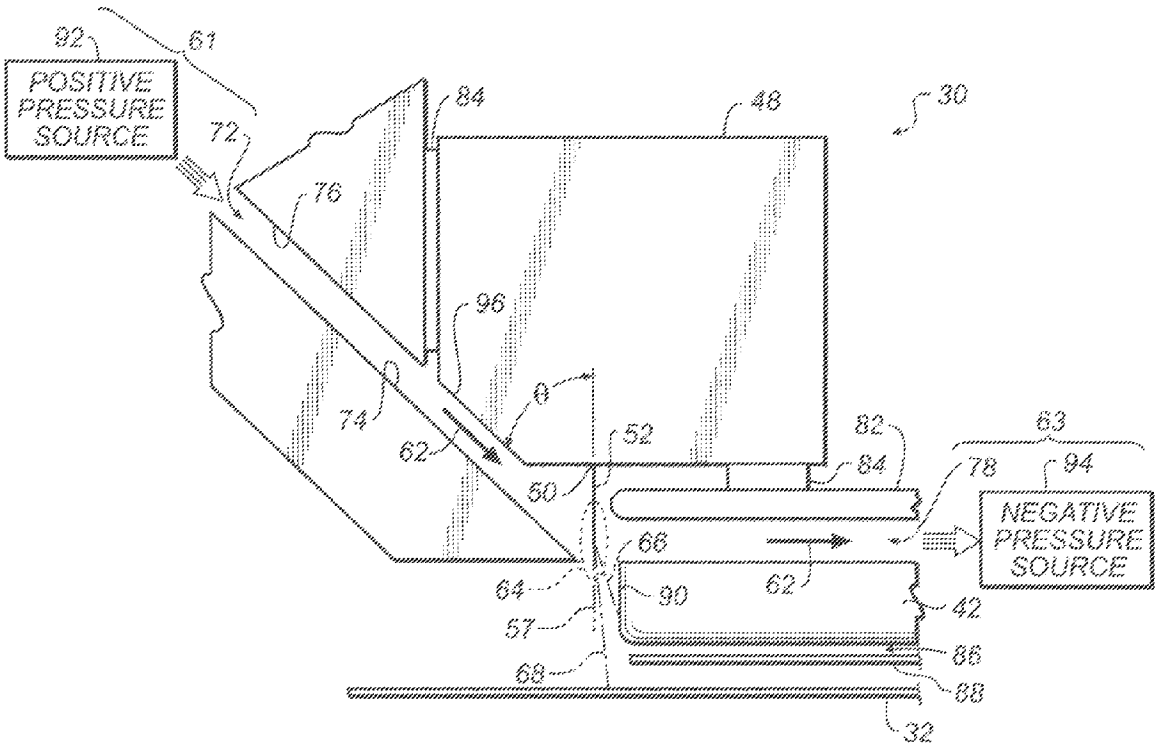
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form streams of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28 (shown FIG. 1) that, when selectively activated, perturbs a portion of liquid 52, for example, ink, to induce portions of an associated liquid stream to break-off from the liquid stream and coalesce to form drops 54, 56.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIG. 1 and FIG. 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIG. 1 and FIG. 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47 (shown in FIG. 2), is emitted under pressure through each nozzle 50 of the array to form streams of liquid 52. In FIG. 3, the array or plurality of nozzles 50 extends into and out of the figure.

Drop stimulation or drop forming device 28 (shown in FIG. 1) is selectively actuated to perturb portions of liquid 52 to induce drops to break off from an associated stream of liquid 52. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to the stream of liquid 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4A:
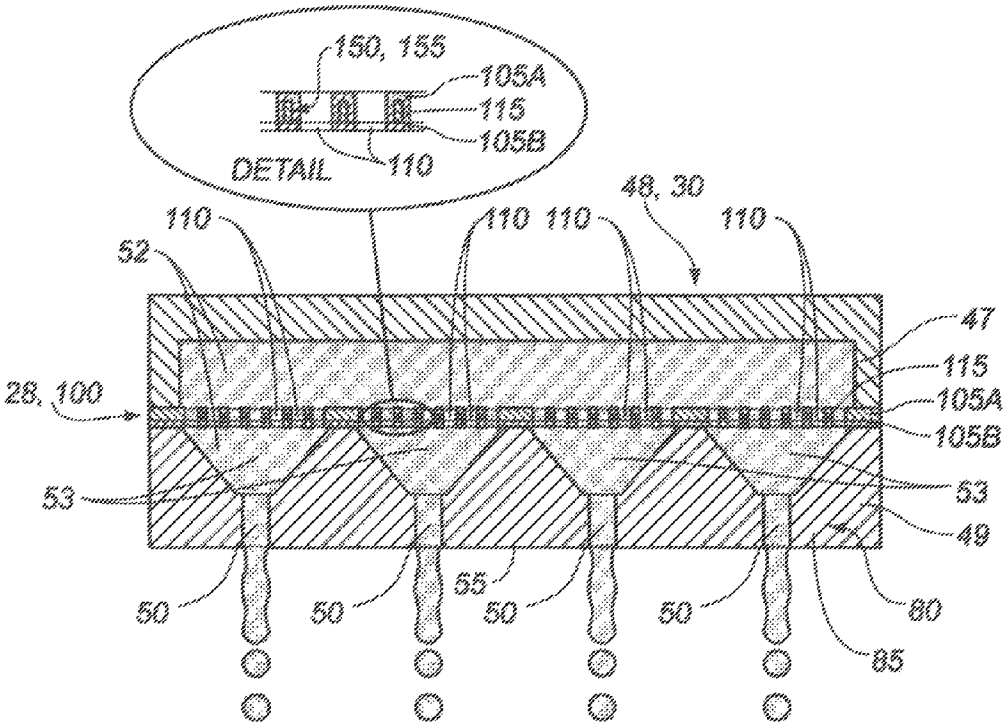
FIG. 4A is a schematic cross-sectional side view of a jetting module made in accordance with the present invention.

FIG. 4A shows a cross-sectional view of a jetting module 48 employed in an example embodiment of the invention. Specifically, cross-sectional views of nozzle plate 49, channel 47 and drop forming device 28 are shown. Channel 47 has been formed in a separate component which has been assembled into jetting module 48. Nozzle plate 49 includes portions 80 defining the plurality of nozzles 50. For clarity, only four (4) nozzles 50 are shown. It is understood that other suitable numbers of nozzles 50 can be employed in other embodiments. The jetting module 48 includes a plurality of liquid chambers 53, which extend from nozzles 50, and each of the liquid chambers 53 corresponds to one of the walled enclosures. In some embodiments, each enclosure includes a wall that includes a plurality of adjoined wall surfaces. In other embodiments, each enclosure includes a wall that forms a continuous wall surface, for example, an oval or circle. Each liquid chamber 53 is arranged to be in fluid communication with a respective one of nozzles 50. In this example embodiment, liquid 52 is provided by channel 47 to each of liquid chambers 53. The ports by which liquid 52 is supplied to channel 47 and by which liquid 52 can be evacuated from channel 47 have been omitted from FIGS. 4A and 4B, described below, for drawing clarity.

Different methods known in the art can be employed to produce components within a printhead 30. Some techniques that are employed to form micro-electro-mechanical systems (MEMS) can also be employed to form components of printhead 30. MEMS fabrication processes typically include modified semiconductor device fabrication technologies. MEMS fabrication techniques also typically combine photo-imaging techniques with etching techniques to form features in a substrate. The photo-imaging techniques are employed to define desired regions of a substrate that are to be etched from other regions of the substrate that should not be etched. MEMS fabrication techniques can be employed to produce nozzle plate 49 along with other printhead elements such as ink feed channels, ink reservoirs, electrical conductors, electrodes and insulator and dielectric components.

Nozzle plate 49 is formed from a substrate 85 using MEMS fabrication techniques. Silicon-based substrates are typically employed for this application because of their relatively low cost, their generally defect-free compositions, and due to the highly developed fabrication processes that have been developed for it. A printhead element can be formed from a single component substrate or a multi-component substrate. In some example embodiments, an employed substrate includes a single material layer, while in other example embodiments the employed substrate includes a plurality of material layers. The printhead element can be formed from a substrate which includes at least one material layer formed by a deposition process, or that includes at least one material layer applied by a lamination process.

In this example embodiment, features such as nozzles 50 and liquid chambers 53 are formed in substrate 85 by an etching process. The etching process includes forming a patterned mask (not shown) on a surface of substrate 85. The patterned mask can be formed by a photolithography process. The patterned mask is typically formed from a photo-imageable polymeric material layer known as a photoresist. Suitable photoresists can include liquid photoresists and dry film photoresists. Uniform coatings of liquid photoresists can be applied to a surface of substrate 85 by methods including spin coating by way of non-limiting example. Dry-film photoresists usually include an assemblage comprising a backing layer and a resist layer. The assemblage is laminated to a surface of substrate 85 and the backing layer is removed while leaving the resist layer in contact with substrate 85.

Regardless of the form that the photoresist takes, it is patterned to define the regions of the substrate 85 that should be substantially etched and other regions of substrate 85 that should not be substantially etched. In example embodiments employing photoresists, these regions can be defined by exposing the photoresist to radiation so as to pattern it. The photoresist can be patterned by radiation that is image-wise conditioned by an auxiliary mask or the photoresist can be patterned directly by one or more radiation beams that are selectively controlled to expose specific regions of the photoresist. The type of radiation that is employed is typically motivated by the composition of the photoresist and can include ultra-violet radiation by way of non-limiting example. The photoresist can undergo additional chemical development steps, and heat treatment steps to form a patterned mask.

Once a patterned mask has been formed, elements such as nozzles 50 are formed by exposing portions of substrate 85 to a suitable etchant though openings in the patterned mask. Without limitation, etching processes suitable for forming elements in printhead 30 can include wet chemical etching processes, vapor etching processes, inert plasma etching processes and chemically reactive plasma etching processes.

Nozzles 50 and liquid chambers 53 can be formed in separate etching processes. For example, both nozzles 50 and liquid chambers 53 can be formed by etching a same surface of substrate 85. Alternatively, different surfaces of substrate 85 can be etched. The different surfaces can include opposing surfaces of substrate 85 by way of example. Different layers of material can be deposited between etching steps.

Each of the liquid chambers 53 is formed from an enclosure whose sidewalls diverge as the enclosure extends away from an associated one of the nozzles 50. Sloped sided structures such as the illustrated liquid chambers 53 can be formed by processes including anisotropic etching techniques. Unlike isotropic etching processes, different etch rates along different directions are associated with anisotropic etching processes. Silicon is an example of a single crystal material that exhibits preferential etching characteristics along crystal planes in the presence of certain chemicals such as potassium hydroxide (KOH). For example, when an opening is etched in a <100> silicon substrate 85, the <111> crystal plane sidewalls of the substrate 85 will be exposed, thereby rendering the opening with sloped or diverging sidewalls.

Referring back to FIG. 4A, drop forming device 28 is shown positioned between nozzle plate 49 and channel 47. Drop forming device 28 is not positioned around the nozzles 50 on surface 55 of nozzle plate 49 from which the streams of liquid 52 are emitted. Rather, drop forming device 28 is positioned internally within jetting module 48 in the vicinity of the entrance to liquid chambers 53. In this example embodiment, drop stimulation device 28 is provided by a membrane-like structure extending across or "spanning" ones of liquid chambers 53. The membrane-like structure is herein referred to as thermal stimulation membrane 100. Thermal stimulation membrane 100 is in contact with and affixed to the entire perimeter of the liquid chamber defined by the wall of the enclosure.

Thermal stimulation membrane 100 can include various material layers and can be formed by various suitable techniques including MEMS fabrication techniques. In this example embodiment, thermal stimulation membrane 100 includes a plurality of insulator material layers 105A and 105B and a resistive material layer 115. Insulator material layers 105A and 105B and resistive material layer 115 can be formed by any suitable process including by deposition or lamination methods as provided by MEMS fabrication techniques. Features in insulator material layers 105A and 105B and resistive material layer 115 can be formed by any suitable process including photolithography and material deposition or etching techniques as provided by MEMS fabrication techniques. Resistive material layer 115 can include materials suitable for use in resistive heating applications. For example, tantalum silicon nitride (TaSiN) is a material employed in resistive heating applications. Insulator material layers 105A and 105B can be formed by various techniques including the use of tetraethyl orthosilicate (TEOS). The present invention is not however limited to these materials and can readily employ other suitable materials having the required resistive or insulator properties as the case may be.

Figure 4B:
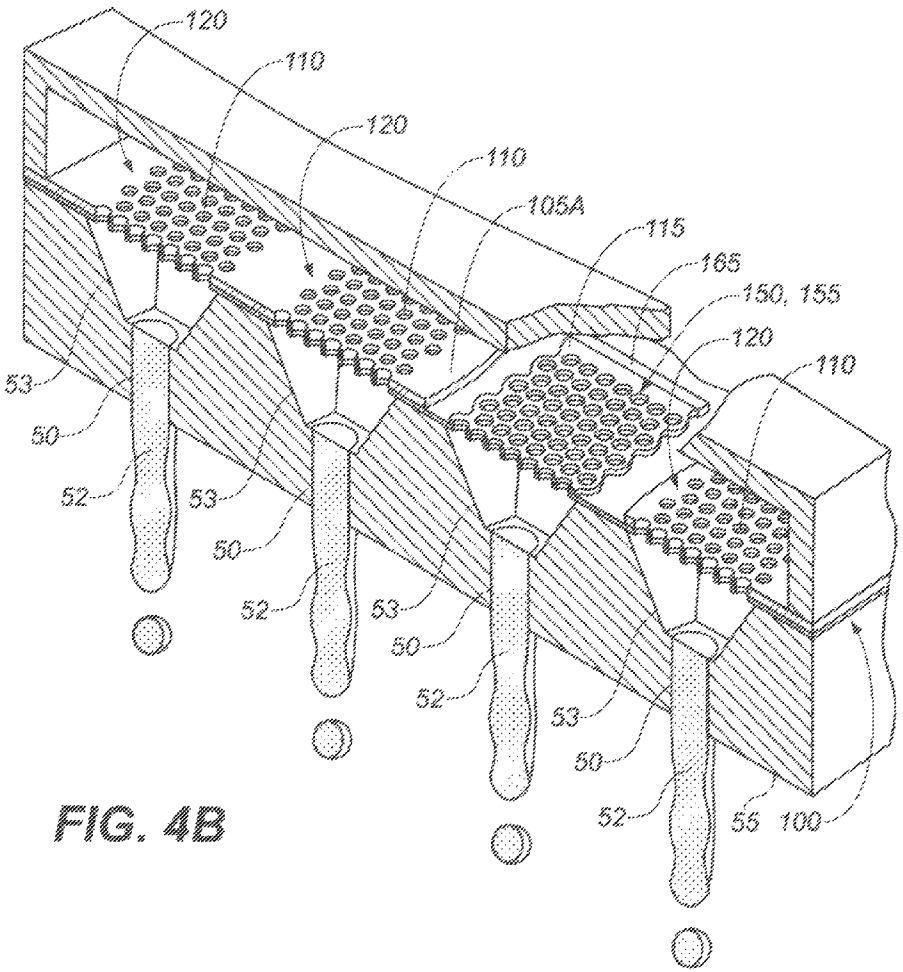
FIG. 4B is a schematic perspective view of the jetting module of FIG. 4A.

FIG. 4B schematically shows a sectional perspective view of thermal stimulation membrane 100 of FIG. 4A. As shown in the DETAIL of FIG. 4A, thermal stimulation membrane 100 includes a plurality of pores 110 and thermal actuators 150 embedded in the membrane material between the pores. A portion of insulator material layer 105A has been removed in FIG. 4B to show a thermal actuator 150.

Pores 110 allow for fluid communication between channel 47 and liquid channels 53. The pores 110 can be arranged in either a regular or random pattern. Pores 110 are grouped together in sets 120, each set 120 corresponding to a different one of the fluid chambers 53. All the liquid 52 entering a given one of the liquid chambers 53 passes through the pores 110 in the set 120 that span the liquid chamber 53. At least one of the pores 110 overlaps a nozzle 50 when viewed from a direction of fluid flow through the nozzle. The walls of the pores 110 include insulator material layers 105A and 105B. Insulator material layer 105A includes a planar surface positioned to intercept a direction of flow of liquid 52 through thermal stimulation membrane 100 from channel 47.

Thermal actuators 150 include one or more resistive heating elements 155 located in resistive material layer 115. As shown in FIGS. 4A and 4B, each of the resistive heating elements 155 includes a resistive material encased in insulator material. In this example embodiment, pores 110 are defined by each of insulator material layers 105A and 105B while thermal actuators 150 are defined by resistive material layer 115.

The drop generator assembly including the nozzles 50, the fluid chambers 53, and the thermal stimulation membrane 100 can be fabricated using any suitable technique. For example, the nozzles 50 and the fluid chambers 53 can be fabricated in substrate 85, as described previously. The fluid chambers can then be filled with a sacrificial material. The layers to form the thermal stimulation membrane can then be formed by appropriate deposition processes, after which the sacrificial material is removed.

Alternatively one can start by forming the thermal stimulation membrane on a substrate. Deposition processes can then be used to form the walls of the fluid chambers 53. The fluid chambers can then be filled with a sacrificial material. The layer that includes the nozzles can then be deposited onto the chamber walls and the sacrificial material. The sacrificial material can then be removed from the fluid chambers. The substrate upon which this structure was formed can then be etched from the back side to form the channel 47 that supplied fluid to the thermal stimulation membrane 100. This process can also be used to create walls that extend beyond the thermal stimulation membrane 100 and then into channel 47. When this is done, liquid chamber 53 can be referred to as a first liquid chamber with the walls that extend beyond the thermal stimulation membrane 100 defining a second liquid chamber. The thermal stimulation membrane 100 is suspended between the first liquid chamber 53 and the second liquid chamber.

Figure 5:
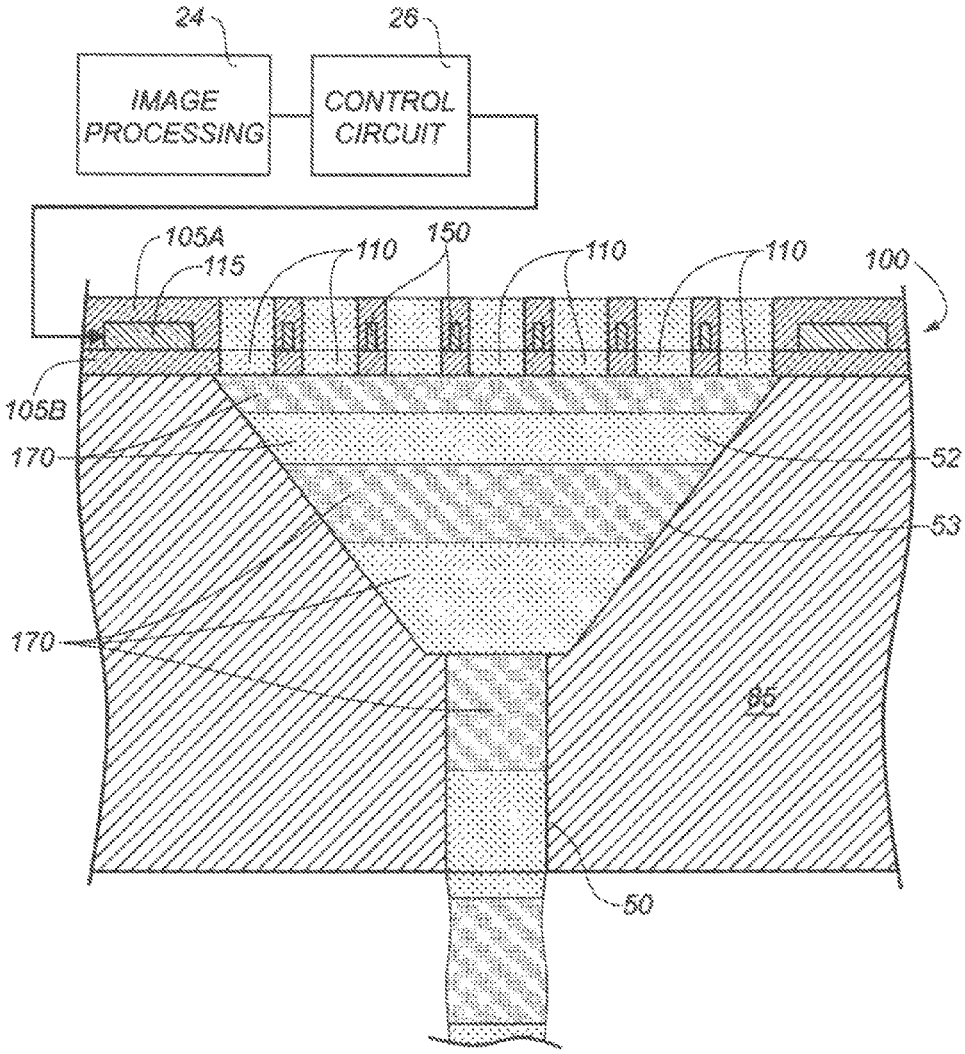
FIG. 5 is a schematic representation of an operation of a thermal stimulation membrane according to an example embodiment of the present invention.

FIG. 5 is a schematic representation of an operation of a part of thermal stimulation membrane 100 shown in FIG. 4A and FIG. 4B. Liquid from the reservoir 40, of FIG. 1, is supplied to the jetting module 48. The liquid entering the channel 47 of the jetting module 48 is supplied at a pressure sufficient to cause the liquid 52 to flow through the pores 110 of the thermal stimulation membrane 100 to enter the liquid chambers 53 and then to flow from the nozzles 50 at a flow rate sufficient to cause continuous streams of liquid 52 to flow from each nozzle 50. The thermal stimulation membrane 100 is operated to selectively heat portions of liquid 52 as the liquid portions flow through thermal stimulation membrane 100 into an associated liquid chamber 53 to be eventually jetted from a nozzle 50. As schematically shown in FIG. 5, data from image processing unit 24 is provided to drop forming device control circuit 26. Drop forming device control circuit 26 includes an electrical source (not shown) that is controlled to apply time-varying electrical pulses to the thermal actuators 150 in the thermal stimulation membrane 100 in accordance with the provided data. In this regard, the electrical energy pulses are selectively provided to thermal stimulation membrane 100 by drop forming control circuit 26 as liquid 52 flows though the pores 110 of thermal stimulation membrane 100. The electrical energy pulses are provided via conductors 165 (shown in FIG. 4B) to thermal actuator 150. The electrical pulses are converted by the thermal actuator 150 into time varying pulses of thermal energy that are applied to liquid 52 as the liquid flows through the pores 110 of thermal stimulation membrane 100.

A drop forming device control circuit 26 is associated with each nozzle 50 since each nozzle 50 is selectively controlled to form combinations of drops comprising different characteristics. In other example embodiments in which each nozzle 50 is employed to provide a uniform stream of drops including substantially constant characteristics (e.g. a substantially constant volume), a single drop forming control circuit 26 can be employed.

Portions of liquid 52 are subjected to the pulses of thermal energy as they travel through their respective pores 110. These portions of liquid 52 subsequently combine to form a liquid thermal layer 170 within liquid chamber 53. Accordingly, different liquid thermal layers 170 can be formed within liquid chamber 53 in accordance with the characteristics of the electrical pulses that are provided to thermal stimulation membrane 100. Factors such as the duration and the voltage of the electrical pulses can be adjusted to create a plurality of liquid thermal layers 170 in which one or more of the liquid thermal layers 170 have different characteristics than others of the liquid thermal layers 170. Different characteristics can include different amounts of thermal energy, different temperatures, velocities, pressures, different densities, viscosities, surface tensions, or combination of these characteristics by way of non-limiting example. In FIG. 5 liquid thermal layers 170 having different characteristics are patterned differently from one another.

As shown in FIG. 5, the liquid thermal layers 170 flow through liquid chamber 53 and into nozzle 50. As liquid 52 is jetted from nozzle 50 the thermal liquid layers 170 become part of the jetted stream and cause the drops to break off from the jetted stream. It is believed that differences in the above described characteristics among the liquid thermal layers 170 cause the stream of liquid 52 to be stimulated in a manner suitable to cause it to break up into a desired stream of drops. The walls of the liquid chamber 53 can be sloped to produce a funneling of the flow toward the nozzle 50, as is shown in FIG. 5, to reduce the mixing or blending the liquid thermal layers 170. Alternatively, walls of the liquid chamber 53 can be straight and positioned perpendicular relative to nozzle plate 49.

While conventional thermal stimulation techniques using a heater embedded in the nozzle plate adjacent to the nozzles have been effective in controlling the formation of drops, the amount of heat that can be transferred to the fluid, and therefore the stimulation amplitude are limited. The present invention, which locates portions of the heater adjacent to a plurality of pores in the thermal stimulation membrane is able to more effectively transfer heat to the fluid, and therefore more effectively stimulate the formation of drops from the stream of liquid flowing from the nozzle.

Figure 6A:
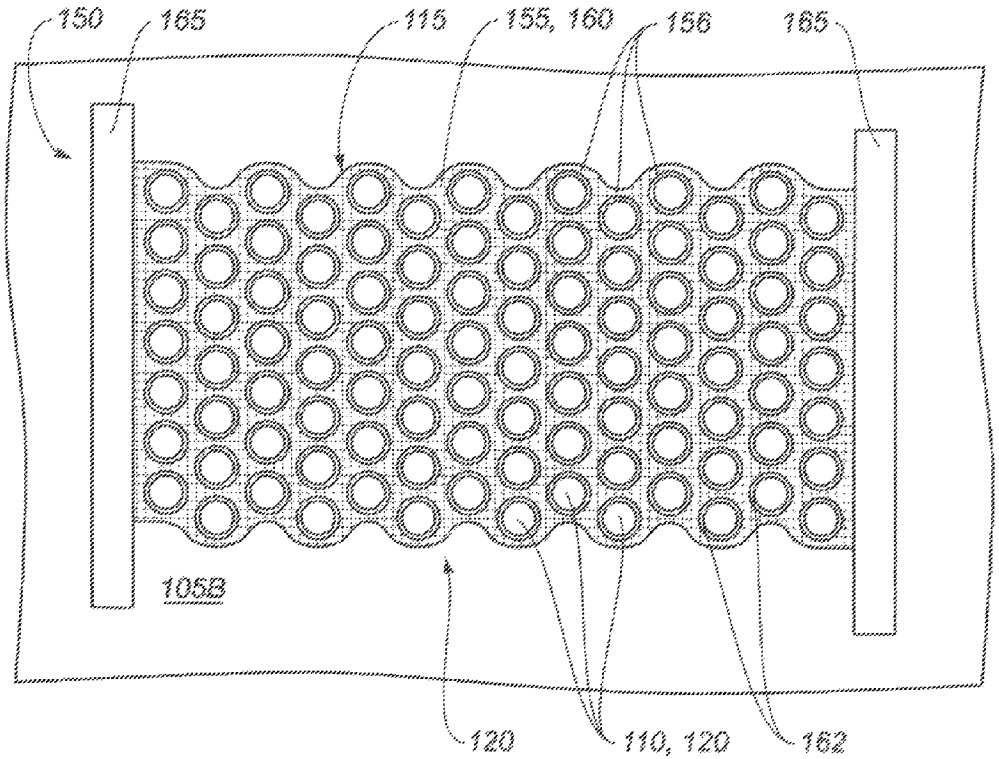
FIG. 6A is a schematic top view of a thermal stimulation actuator according to another example embodiment of the invention.

Thermal actuators 150 can take various forms in the present invention. For example, FIG. 6A schematically shows a planar view of the resistive heating element 155 shown in FIG. 4B. Resistive heating element 155 is formed from a resistive material 160 in resistive material layer 115. Insulator material layer 105B is shown underlying resistive material layer 115 while portions of insulator material layer 105A are not shown for clarity. The pores 110 in a set 120 are defined at least in part by insulator material layer 105B. In this example embodiment, the ability to transfer thermal energy to a portion of liquid 52 as it flows through a pore 110 is related to the spatial distribution of resistive material 160 to the pore 110.

The resistive heating element 155 comprises a single element with a plurality of openings 156, each opening corresponding to one of the pores 110. Conductors 165 made from an electrically conductive material (e.g. aluminum) are arranged to provide the pulses of electrical energy to resistive heating element 155 as provided by drop forming device control circuit 26 (not shown in FIG. 6A). Resistive material 160 is located on all sides of each pore 110 in set 120. Resistive material 160 is distributed symmetrically around each of the pores 110. An electrically insulating material 162 lines each opening 156 and electrically isolates the resistive material 160 from the liquid 52 as it flows through the pore 110. Insulator material 162 can be applied by any suitable coating or deposition processes. Insulator material 162 can be part of an insulator material layer such as un-illustrated insulator material layer 105A by way of non-limiting example. Resistive material 160 can be encased by an insulator material to prevent electrolysis when used with conductive liquid. In the embodiment of FIG. 6A, resistive heating element 155 is arranged to provide thermal pulses of energy uniformly or evenly to all sides of the liquid 52 that flows through each of the pores 110 in set 120.

Figure 6B:
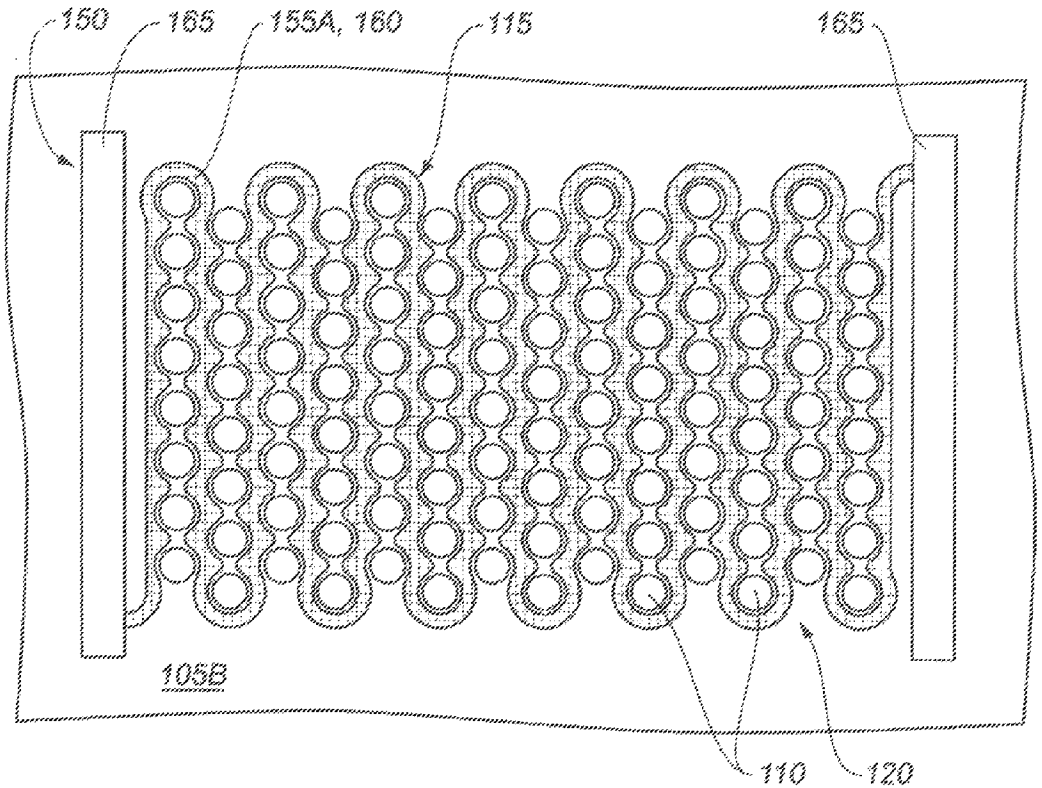
FIG. 6B is a schematic view of a thermal stimulation actuator according to another example embodiment of the invention.

FIG. 6B schematically shows a planar view of another example embodiment of a thermal actuator 150. The thermal actuator 150 includes a resistive heating element 155A. In a similar manner to the example embodiment shown in FIG. 6A, resistive heating element 155A is formed from resistive material layer 115 which overlies insulator material layer 105B. Insulator material layer 105A is again not shown for clarity. The resistive heating element 155A is an elongate member connected between conductors 165. Resistive heating element 155A extends along a serpentine path among the pores 110. The serpentine path is arranged such that resistive material 160 is located on one or more sides of a pore 110 but not all sides of the pore. However, the serpentine path is such that resistive material 160 is distributed symmetrically around the pores 110. The extensively elongated form of the resistive heating element may be used to increase the effective resistance of resistive heating element 155A for a given resistivity of the resistive material 160.

Figure 6C:
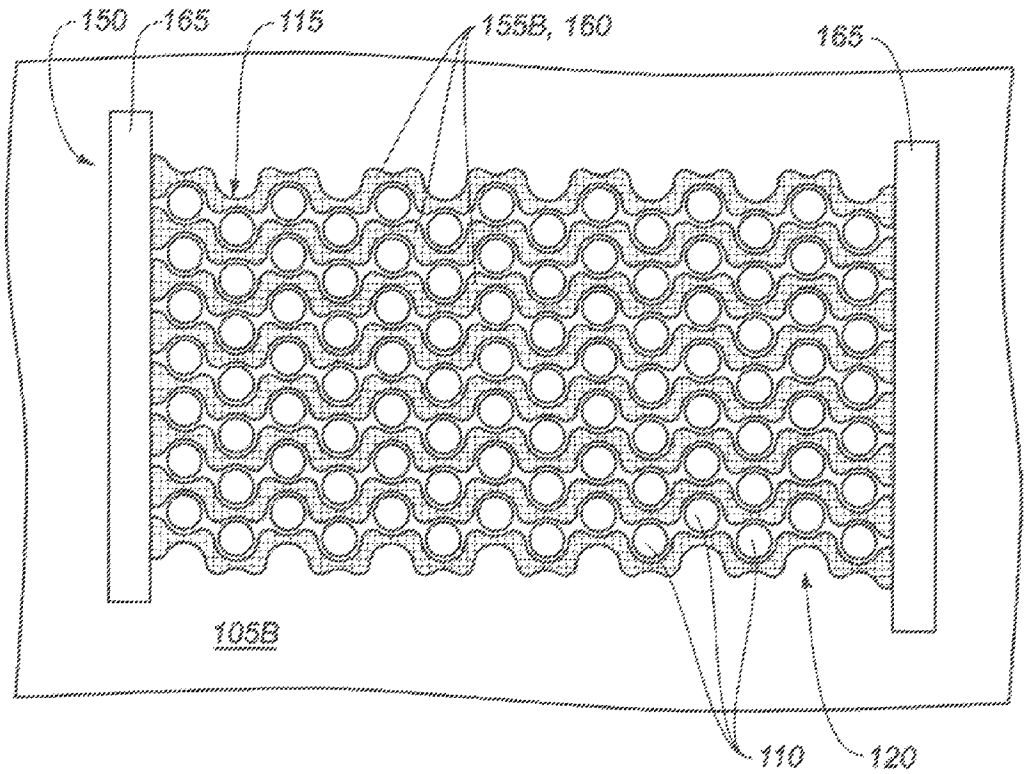
FIG. 6C is a schematic view of a thermal stimulation actuator according to another example embodiment of the invention.

FIG. 6C schematically shows a planar view of a plurality of resistive heating elements 155B employed in a thermal actuator 150 according to another example embodiment of the invention. In a similar manner to the example embodiments shown in FIG. 6A and FIG. 6B, each resistive heating element 155B is formed from resistive material layer 115 which overlies insulator material layer 105B. Insulator material layer 105A is again not shown for clarity. The resistive heating elements 155B are arranged in a mutually parallel circuit arrangement between conductors 165; that is, the resistive heating elements are arranged as electrically parallel circuits, they are not necessarily geometrically parallel to each other. In a similar fashion to resistive heating element 155A, the plurality of the resistive heating elements 155B are arranged such that resistive material 160 is located on several sides of a pore 110. In particular, the resistive heating elements 155B are arranged such that resistive material 160 is located on one or more sides, but not all sides, of each pore 110.

Each of the resistive heating elements 155B is connected to a common set of conductors 165 adapted to distribute an electrical energy pulse to each of the resistive heating elements 155B. In other embodiments, one or more of the resistive heating elements 155B can be connected to different sets of one or more conductors 165, each set of conductors 165 being adapted to distribute electrical energy pulses having different characteristics to their respective resistive heating elements 155B. Different characteristics of the electrical energy pulses can include different pulse-widths, pulse voltages and pulse timings by way of non-limiting example. In this manner, different thermal characteristics can be selectively imparted to different portions of liquid 52 as they flow through their respective pores 110. For example, pulse delay timings may be employed to cause different portions of liquid 52 to be heated at slightly different times. The delays may be desired for different reasons including to account for possible different flow characteristics or different flow paths of outboard portions of liquid 52 as compared to inboard portions of liquid 52 in fluid chamber 53. Alternatively, deflection of the subsequently formed stream of liquid 52 can be accomplished by applying heat asymmetrically to portions of liquid 52 entering liquid chamber 52. When used in this capacity, the present invention operates as the drop forming device in addition to a deflection mechanism. This type of drop formation and deflection is known having been described in, for example, U.S. Pat. No. 6,079,821, issued to Chwalek et al., on Jun. 27, 2000.

Figure 6D:
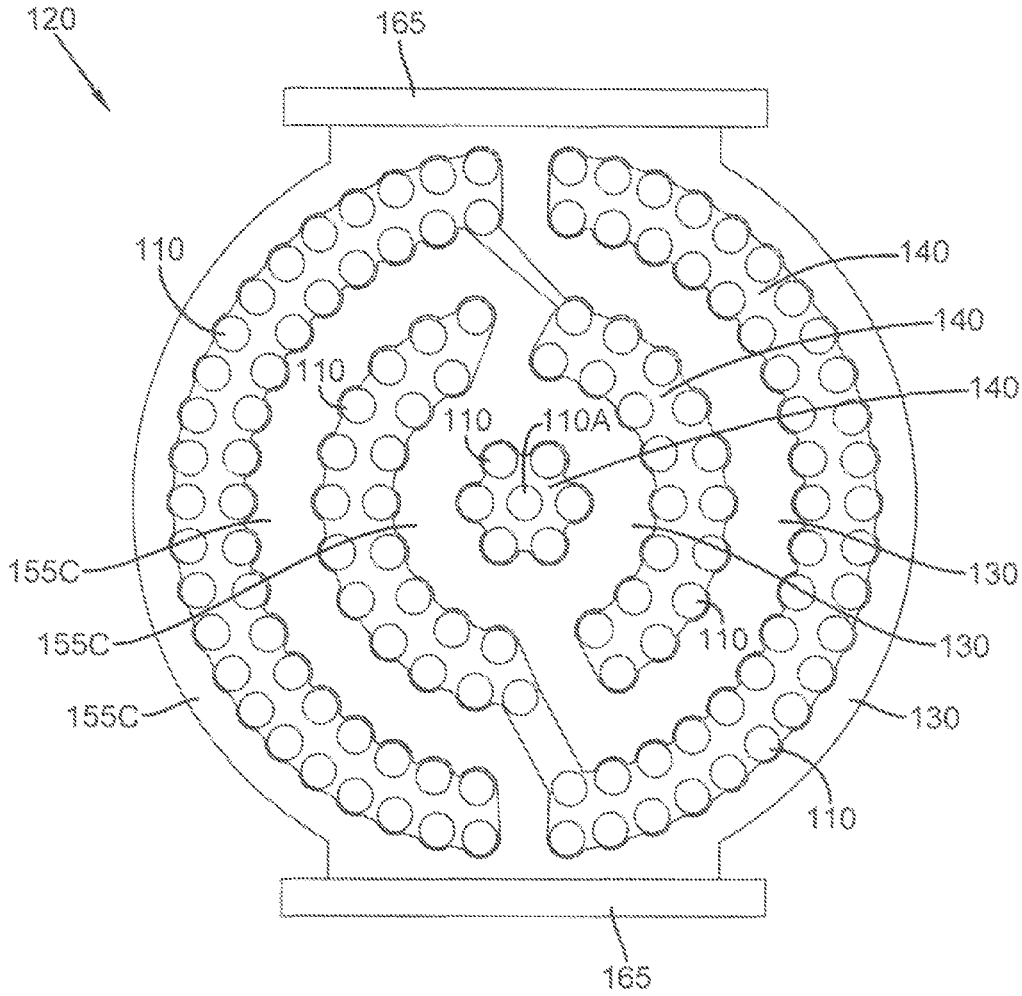
FIG. 6D is a schematic view of a thermal stimulation actuator according to another example embodiment of the invention.

Another example embodiment is shown in FIG. 6D. In this embodiment, the pores 110 of a set 120 of pores and the resistive heating elements 155C associated with a liquid chamber and a nozzle are more segregated than in the other embodiments. The thermal stimulation membrane 100 associated with the liquid chamber and nozzle has one or more first portions 130 that include the resistive heating elements 155C forming the heater and one or more second portions 140 in which the plurality of pores 110 are clustered. Such clustering of the pores and heater segments into separate portions can be employed to facilitate transfer of the thermal energy to those portions of the fluid flow that contribute most significantly to the stimulation of drop break off from the liquid stream. With such clustering of the pores into the second portions 140, it is not necessary for every pore to have a heater along one of its sides. For example the central pore, 110A, does not have a heater along any of its sides. In some example embodiments, the first portion 130 that includes pores 110 is located on one side of the second portion 140 that includes the thermal actuators 150. The first portion 130 and the second portion 140 of thermal stimulation membrane 100 can be located on the same plane.

The example embodiments of the invention increase the transfer of heat to the liquid 52 that is stimulated to eventually form a stream of drops when jetted from nozzle 50. This is accomplished by employing the plurality of pores 110 to divide liquid 52 into numerous small portions and by transferring thermal energy to these portions as they flow through their respective pores 110. It is understood that additional and/or alternate components can be employed to further enhance the workings of the present invention. For example, the path traveled by liquid 52 through any of the pores 110 should be kept short to avoid excessive pressure losses. This can lead to a relatively thin thermal stimulation membrane 100 that may not be well suited to withstanding the high fluid pressures associated with the continuous printer systems. Accordingly, support features (not shown) can be provided. Support features can be formed in substrate 85 or other members. Additional components comprising cooling, heat dissipation or heat sink properties (not shown) can be formed to dissipate residual heat in thermal stimulation membrane 100, as described, for example, in US 2008/0043062 for use with thermal stimulator devices located in the nozzle plate around the nozzle.

The plurality of pores 110 can include pores of different sizes. In some example embodiments, the plurality of pores 110 have more than one pore dimension. Some of the pores 110 can be employed for alternate and/or additional functions. For example, a set 120 of pores 110 can include at least one pore 110 that is adapted for filtering particulate matter from liquid 52 without serving to couple heat into the fluid passing through the pore. Such pores would not have any resistive material located on any side. The size of the at least one pore 110 can vary in accordance with a measured or predicted size of particulate matter within liquid 52. The number of pores 110 employed can be tailored to account for the flow impedance through the pores 110 and therefore the pressure drop across the thermal stimulation membrane 100 and the quantity of liquid 52 that is desired to be thermally stimulated. Combining stimulation and filtration function as per the example embodiments of the invention can simplify the manufacture of a continuous printer system printhead.

The invention has been described in detail with particular reference to certain preferred embodiments thereof, but it will be understood that variations and modifications can be effected within the scope of the invention.

Parts List

20 continuous printer system
22 image source
24 image processing unit
26 mechanism control circuits
28 drop forming device
30 printhead
32 recording medium
34 recording medium transport system
36 recording medium transport control system
38 micro-controller
40 reservoir
42 catcher
44 recycling unit
46 pressure regulator
47 channel
48 jetting module
49 nozzle plate
50 plurality of nozzles
52 liquid
53 liquid chambers
54 drops
55 surface
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
80 portions
82 upper wall
85 substrate
86 liquid return duct
88 plate
90 front face
92 positive pressure source
94 negative pressure source
96 wall
100 thermal stimulation membrane
105A insulator material layer
105B insulator material layer
110 pores
115 resistive material layer
120 set
130 first portion
140 second portion
150 thermal actuator
155 resistive heating element
155A resistive heating element
155B resistive heating elements
155C resistive heating elements
156 openings
160 resistive material
162 insulator material
165 conductors
170 liquid thermal layer

The invention claimed is:

1. A continuous liquid ejection printhead comprising:
a jetting module including:
a nozzle plate, portions of the nozzle plate defming a nozzle;
a thermal stimulation membrane including a plurality of pores; and
an enclosure including a wall that extends from the nozzle plate to the thermal stimulation membrane to define a liquid chamber positioned between the nozzle plate and the thermal stimulation membrane, the liquid chamber being in fluid communication with the nozzle, the liquid chamber being in fluid communication with the plurality of pores of the thermal stimulation membrane; and
a liquid source that provides a liquid under pressure sufficient to jet an individual stream of the liquid from the nozzle of the jetting module after the liquid passes through at least some of the plurality of pores of the thermal stimulation membrane.

2. The printhead of claim 1, wherein the wall extends beyond the thermal stimulation membrane.

3. The printhead of claim 1, the liquid chamber being a first liquid chamber, the wall extending beyond the thermal stimulation membrane defining a second liquid chamber, the thermal stimulation membrane being suspended between the first liquid chamber and the second liquid chamber.

4. The printhead of claim 1, the thermal stimulation membrane including a resistive material encased in an insulator material, wherein at least some of the plurality of pores are positioned in the thermal stimulation membranes such that resistive material is located on all sides of each pore.

5. The printhead of claim 1, the thermal stimulation membrane including a resistive material encased in an insulator material, wherein at least some of the plurality of pores are positioned in the thermal stimulation membrane such that resistive material is located on one or more sides of each pore but not on all sides of each pore.

6. The printhead of claim 1, the thermal stimulation membrane including a resistive material encased in an insulator material, wherein at least one of the plurality of pores is positioned in the thermal stimulation membrane such that no resistive material is located on any side of the at least one of the plurality of pores.

7. The printhead of claim 1, wherein the liquid chamber includes a substantially triangular cross section when viewed in a plane perpendicular to the thermal stimulation membrane and the nozzle, the cross section being smaller at the nozzle when compared to the cross section at the thermal stimulation membrane.

8. The printhead of claim 1, wherein the plurality of pores have one pore dimension.

9. The printhead of claim 1, wherein the wall of the enclosure is sloped.

10. The printhead of claim 1, wherein the wall of the enclosure forms a continuous surface.

11. The printhead of claim 1, wherein the wall of the enclosure includes a plurality of adjoined wall surfaces.

* * * * *